US007045947B2

(12) United States Patent
Van Der Vaart et al.

(10) Patent No.: US 7,045,947 B2
(45) Date of Patent: May 16, 2006

(54) VACUUM DISPLAY DEVICE

(75) Inventors: Nijs Cornelis Van Der Vaart, Eindhoven (NL); Martin Gerard Hendrik Hiddink, Eindhoven (NL); Siebe Tjerk De Zwart, Eindhoven (NL); Antonius Hendricus Maria Holtslag, Eindhoven (NL); Theunis Siemen Baller, Eindhoven (NL); Hans-Helmut Bechtel, Roetgen (DE); Georg Friedrich Gaertner, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 179 days.

(21) Appl. No.: 10/494,608

(22) PCT Filed: Oct. 24, 2002

(86) PCT No.: PCT/IB02/04447

§ 371 (c)(1),
(2), (4) Date: May 4, 2004

(87) PCT Pub. No.: WO03/041039

PCT Pub. Date: May 15, 2003

(65) Prior Publication Data

US 2004/0256976 A1 Dec. 23, 2004

(30) Foreign Application Priority Data

Nov. 9, 2001 (EP) ..... 01204291

(51) Int. Cl.
*H01J 1/62* (2006.01)

(52) U.S. Cl. ..... 313/495; 313/292

(58) Field of Classification Search ..... 313/422, 313/495, 309, 310, 336, 351, 238, 273
See application file for complete search history.

(56) References Cited

U.S. PATENT DOCUMENTS

| | | | | |
|---|---|---|---|---|
| 5,270,611 | A | 12/1993 | van Gorkom | |
| 5,986,399 | A | 11/1999 | van Veen | |
| 6,259,765 | B1 * | 7/2001 | Baptist | 378/136 |
| 6,509,687 | B1 * | 1/2003 | Natarajan et al. | 313/495 |

FOREIGN PATENT DOCUMENTS

| | | |
|---|---|---|
| WO | WO 01/26131 | 4/2001 |

* cited by examiner

*Primary Examiner*—Vip Patel

(57) ABSTRACT

The invention relates to a vacuum display device comprising a display screen (30) having picture elements (35), cathode means (20) for generating a plurality of electron beams (EB), each corresponding to one of the picture elements (35), and addressing means (41,42) for addressing the picture element (35) through modulation of the intensity of an electron beam corresponding to the picture element (35). A channel structure (10) is arranged adjacent the cathode means (20). The channel structure (10) comprises a plurality of electron beam guidance cavities (15), each corresponding to one of the picture elements (35), and protects the cathode means (20) from incident ions. The exit (17) of the cavity (15) is smaller than the entrance (16), so that an electron beam (EB) exiting from the cavity (15) has a particularly high brightness and spatial uniformity.

14 Claims, 6 Drawing Sheets

VACUUM DISPLAY DEVICE

The invention relates to a vacuum display device comprising a display screen for displaying image information, said display screen comprising luminescent picture elements arranged in a first array;

cathode means for forming a plurality of electron beams arranged in a second array, said second array being in conformity with the first array, so that each electron beam corresponds to a picture element of the display screen;

addressing means for addressing the picture elements by modulating the corresponding electron beam in accordance with the image information, and a channel structure provided with electron beam guidance cavities arranged in a third array, said third array being in conformity with the first array, for guiding each electron beam to the corresponding picture element of the display screen, said electron beam guidance cavities each having an entrance facing the cathode means and an exit aperture facing the display screen.

An embodiment of such a display device is known from U.S. Pat. No. 5,986,399.

In the known display device, the cathode means comprise microtip field emitters, also known as Spindt emitters, for each of the picture elements (pixels). When a cathode electrode adjacent the microtip is activated by a cathode voltage, electrons are emitted from the microtip because of the relatively strong local electric field at the microtip.

The electrons emitted from the microtip are accelerated towards a corresponding pixel of the display screen by an electric field. For this purpose, said display screen is provided with an anode which receives an anode voltage. The pixels comprise luminescent material that emits light when struck by an electron beam and are arranged in rows and columns.

The known display device is provided with addressing means. In particular, the microtips are controllable by column electrodes for energizing columns of microtips, and grid electrodes are provided, separated from the column electrodes by an insulating layer and extending in a direction perpendicular to the columns, so as to modulate a beam current of the rows of electron beams. Thus, each of the pixels on the display screen is addressable by a corresponding combination of a column electrode and a grid electrode.

By addressing the pixels in accordance with image information supplied to the display device, said image information can be displayed on the screen.

In the known display device, a selection plate is provided. The selection plate is provided with an aperture for each of the pixels. The inner surface of each aperture is provided with a metallization pattern. The apertures guide an electron beam to the corresponding pixel of the display screen. The selection plate is mounted close to the display screen to obtain a substantially 1:1 relation between the apertures and the pixels.

The known display device has the problem that the brightness of the displayed image deteriorates over the lifetime of the device.

It is an object of the invention to provide a vacuum display device as described in the opening paragraph which has a reduced deterioration of the image brightness over its lifetime.

This object is realized by the vacuum display device according to the invention, which is characterized in that the channel structure is arranged adjacent the cathode means, and said entrance is larger than said exit aperture.

The invention is based on the recognition that the emissive properties of the cathode means are reduced over the lifetime of the device owing to positive ions being formed in the device. After vacuum conditions have been established in the display device, residual gases having a low partial pressure are still present. These residual gases are ionized when struck by an electron beam. The resulting positive ions move in opposite direction to the electrons and are thus accelerated towards the cathode means, which may be damaged upon ion collision. The brightness of the emitted electron beam and thus the image brightness is reduced thereby over the lifetime of the display device.

In the display device according to the invention, the channel structure is arranged adjacent the cathode means. A large majority of the positive ions is therefore generated between the channel structure and the display screen. Since the surface area of the exit apertures is relatively small as compared with the surface area of the entrances and thus the surface area of the channel structure, the positive ions predominantly collide with the channel structure. The channel structure forms an obstruction to ions that are accelerated towards the cathode means.

The number of ions colliding with the cathode means is reduced, because the fraction of the positive ions entering the electron beam guidance cavities through the exit aperture and subsequently reaching the cathode means is relatively small. Therefore, damage inflicted on the cathode means during the lifetime of the display device is reduced. In the display device according to the invention, the deterioration of the beam current of the emitted electron beams, and thus the deterioration of image brightness, is reduced over the lifetime of the display device.

Moreover, since the entrance is larger than the exit aperture, the electron beam guidance cavity concentrates the electron beam, so that it has a relatively high brightness. Also, the spatial distribution of the electron beam is relatively uniform. Therefore, intra-pixel luminescence is particularly uniform and the image quality is relatively high.

The exit aperture may be circular or square-shaped, or preferably have an elongate shape such as elliptical or rectangular.

Where, in the remainder of this document, the word "cavity" is used, reference is made to an electron beam guidance cavity being provided in the channel structure.

Although the display device according to the invention has an advantage for any ratio between the surface areas of the exit aperture and the entrance greater than 1, it is preferred that this ratio is considerably greater than 1, for example 5 or 20.

The channel structure may be provided with a hop electrode on its screen-facing side for each of the exit apertures of the cavity, and the inner surface of each of the cavities may comprise electrically insulating material having a secondary emission function. These features enable electron beam guidance through the cavities. This particular electron beam guidance is based on hopping transport of the electrons, as known per se from U.S. Pat. No. 5,270,611.

Hopping transport of the electrons is based on a secondary emission process. In operation, the hop electrode receives a hop voltage, so that electrons in the cavity are accelerated towards the exit aperture. The inner surface of the cavity comprises an electrically insulating material having a secondary emission function. When an electron strikes upon the inner surface, it is absorbed and a secondary electron is released and accelerated towards the exit aperture. For each emitted electron that enters the cavity, on average one electron is emitted from the exit aperture. Thus, on average, as many electrons leave the cavity as enter it and the electron beam is guided through the cavity.

This embodiment is particularly advantageous if an anode is provided in the display screen for accelerating the electrons. Because of the relatively small exit aperture and the presence of the hop electrode, the accelerating electric field of the anode has a negligible perveance through the channel structure. Therefore, the acceleration stage does not interfere with the electron beam generation by the cathode means. The anode voltage and the cathode voltage can be chosen independently of each other.

Usually, a relatively high anode voltage is applied for accelerating the electrons. The electrons in the electron beams impact on the pixels with a relatively high impact energy so that light generation by the luminescent material is particularly efficient, while the cathode voltage can be chosen so as to be best suitable for the type of electron emitter used in the display device.

The electron beam guidance cavity is preferably substantially funnel-shaped, an apex angle of the funnel being, for example, in a range from 10 to 100 degrees and preferably between 30 and 80 degrees.

The inventors have shown that the electron beam exiting from such a cavity leads to a favorable and particularly uniform filling of the pixels.

Moreover, the threshold hop voltage, being the hop voltage needed to start the hopping electron transport, is relatively low, and the hopping transport process is established at a relatively low hop voltage.

Preferably, the cathode means comprise at least one field emitter for each of the electron beams. Thus, this embodiment of the display device according to the invention is, in essence, a Field Emission Display (FED). The field emitters only require a relatively low power for generating an electron beam with a sufficiently high beam current.

This embodiment is particularly advantageous if the number of field emitters for each of the electron beams is relatively large. In known embodiments of FEDs, problems with intra-pixel luminescence uniformity and fluctuations in the beam current of the emitted electron beam commonly occur. These problems are reduced in this embodiment because the cavities concentrate the emitted electrons from a relatively large number of field emitters into a single electron beam.

The field emitters preferably comprise Spindt-type emitters, printed field emitters, or carbon nanotubes.

Alternatively, the cathode means may comprise one or more thermionic emitters, such as an oxide-cathode. The dimension of this cathode may be comparable to that of the display screen, or it may have several segments.

Preferably, the cathode means comprise a cathode electrode for each of the electron beams, so as to enable electron emission from a corresponding part of said cathode means, and a gate electrode for each of the electron beams, so as to control the electron emission from the corresponding part of said cathode means.

The first array, the second array, and the third array generally comprise rows and columns. The rows and columns may both be arranged along straight, perpendicular lines, or alternatively in a so-called delta-nabla configuration, wherein the rows are arranged along a straight line and the columns are arranged in a sawtooth pattern substantially perpendicular to the rows.

In a preferred embodiment, the addressing means then comprise a row electrode and a column electrode, the row electrode connecting the gate electrodes of electron beam guidance cavities arranged in a corresponding row, and the column electrode connecting the hop electrodes of electron beam guidance cavities arranged in a corresponding column.

In operation, a given picture element is addressable by the application of a row voltage to the corresponding row electrode and by the application of a column voltage to the corresponding column electrode.

Generally, the pixels are addressed 'line-at-a-time', whereby a first of the voltages, for example the row voltage, is used for selecting a row of electron beams, and a second of the voltages, in this example the column voltage, is used for modulating the beam current independently for each of the electron beams in the selected row.

Each row is selected once for every frame being written, thus the row voltage is generally a signal having a frame frequency. Each column voltage is adapted once for every line being written, thus the column voltage is generally a signal having a line frequency. The beam current modulation may be carried out by means of pulse height modulation or by means of pulse width modulation.

The column voltage has a line frequency, which is considerably greater than the frame frequency, usually several hundred times greater. The preferred embodiment has the advantage that the power usage for pixel addressing is relatively low, because the column voltage is applied to the hop electrodes, which have a relatively small capacitive load.

The 'line-at-a-time' addressing method described above is commonly referred to as 'normal scanning'. It is alternatively possible to use 'transposed scanning', in which the roles of the row and column voltages are interchanged. In the remainder of this document, it is presumed that normal scanning is used for pixel addressing.

The cathode electrodes may be arranged in segments, each corresponding to a plurality of electron beams arranged in a predetermined number of rows of the second array. For example, the number of segments is ten.

In operation, the segmented cathode electrodes are used for multiplexing addressing of the rows of pixels. This has the advantage that the number of row voltages, and thus the number of external connections to supply the row voltages, is reduced.

Alternatively, the roles of the cathode electrodes and the gate electrodes may be interchanged, so that rows of pixels are selectable by means of cathode electrodes corresponding to the rows, and segmented gate electrodes are used for multiplexing addressing of the rows.

In an alternative embodiment, the addressing means comprise a row electrode and a column electrode, said row electrode connecting the cathode electrodes of electron beams arranged in a corresponding row, and said column electrode comprising the gate electrodes of electron beam guidance cavities arranged in a corresponding column. The rows of pixels are addressable by the cathode electrodes, and the columns of pixels are addressable by the gate electrodes.

This is advantageous because a single hop electrode can be provided for all cavities, said hop electrode receiving a fixed hop voltage and having similar dimensions as the third array of the cavities.

Because of this, the hopping transport properties of the cavities remain relatively unchanged during operation of the display device. Moreover, the addressing of the individual pixels is now entirely carried out within the cathode means, which are electrically isolated from the acceleration stage by the channel structure.

The display device operates under vacuum conditions. In a preferred embodiment, the display device comprises a vacuum envelope having a back plate adjacent the cathode means, a front plate adjacent the display screen, and a spacer between the front plate and the back plate, said spacer comprising a plurality of chambers, each arranged between a predetermined number of picture elements and their corresponding electron beam guidance cavities, and a pump chamber designed for pumping the vacuum envelope and connected to each one of the plurality of chambers.

The spacer provides support to the display device, to withstand the atmospheric pressure. This is necessary for achieving vacuum conditions within the display device. The manufacturing process of the display device comprises a step of evacuating the display device, during which step the pump chamber is connected to a pump.

Preferably, the vacuum conditions prevail throughout the entire display device, and the pumping resistance of the display device is as low as possible.

An embodiment of such a spacer has a single chamber for each of the pixels, extending between the pixel and the exit of the corresponding electron beam guidance cavity.

To connect each chamber to the pump chamber, the channel structure may be provided with openings between neighboring cavities, so as to connect rows of cavities, columns of cavities, or both. The cavities adjacent the sides of the cavity structure are connected to said pump chamber by similar openings. The dimensions of the openings should be large enough to allow an unrestricted gas flow between neighboring cavities, yet small enough to prevent electron leakage between neighboring cavities.

Alternatively, such openings may be provided within the spacer to connect chambers corresponding to neighboring pixels.

The spacer having a single chamber for each pixel prevents electrons from landing on a wrong pixel, i.e. a pixel not corresponding to the cavity from which the electron exited. This is especially advantageous in a color display device, so as to prevent color errors in the displayed image.

Another embodiment of the spacer is provided with a single chamber for a predetermined number of picture elements arranged in a single column of the first array.

In this embodiment, electron leakage to pixels in a neighboring column is not possible. This is especially advantageous in a color display device, if the luminescent material for the different colors is arranged in strips, each of the strips corresponding to the predetermined number of pixels arranged in the column. This configuration also prevents the occurrence of color errors. However, some electron leakage may occur between the pixels arranged in the column.

It is advantageous when the hop electrode comprises an electron lens adjacent each of the exit apertures of the cavities for adapting a cross-sectional area and/or shape of the corresponding electron beam in conformity with the picture elements of the display screen.

The shape and diameter of the exit aperture can thus be chosen independently of the picture elements on the display screen, so that a large design freedom is obtained. The electron beam exiting from the guidance cavity is formed by the electron lens to give a good filling of the corresponding luminescent pixel of the display screen. This is advantageous for an efficient use of the luminescent material in the pixel, and therefore for the brightness of the displayed image.

Such an electron lens may comprise a cup lens or a planar electron lens, which are both known from international patent application WO 01/26131.

These and other aspects of the invention will be apparent from and elucidated with reference to the appended drawings.

Figure 1:
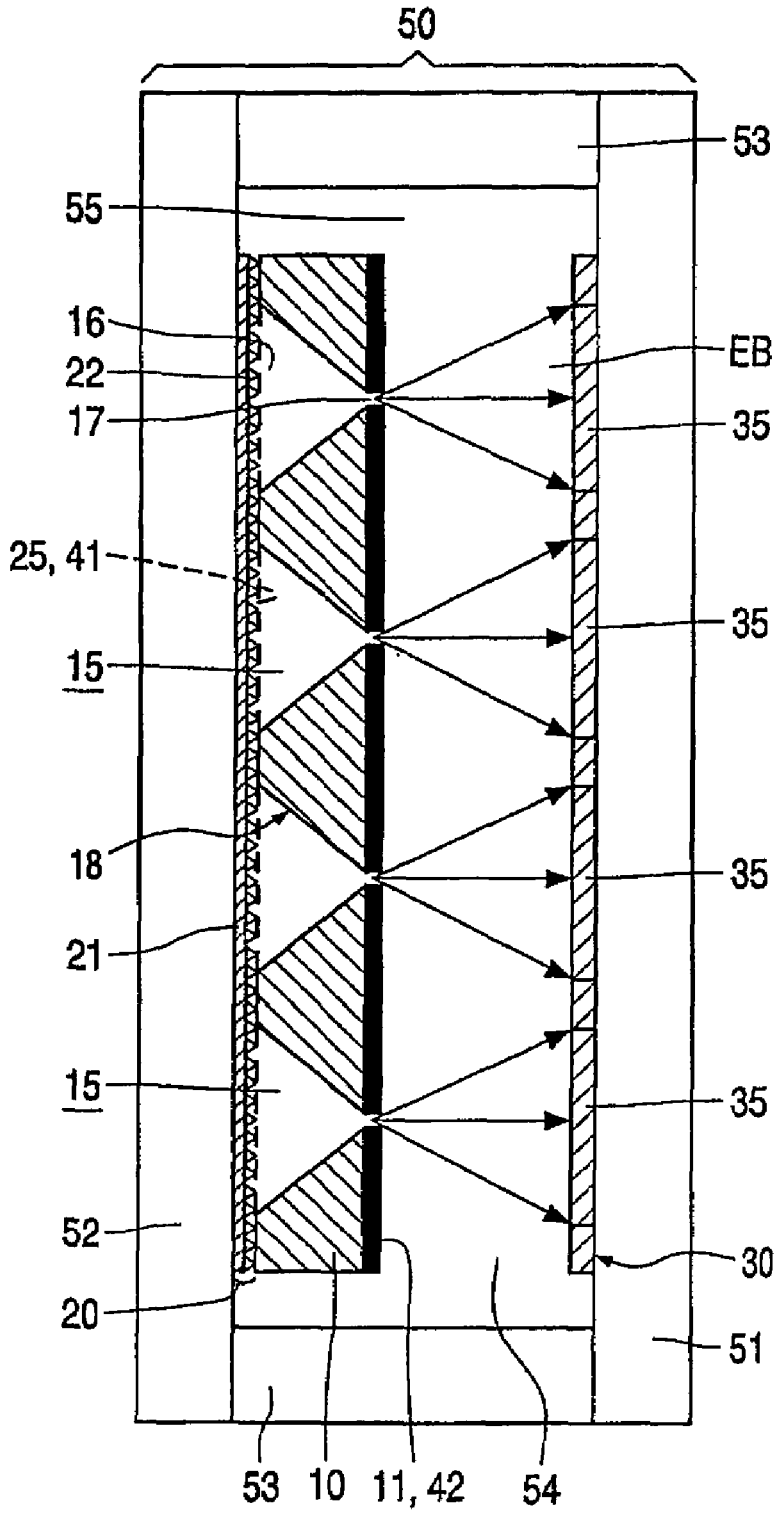
FIG. 1 shows a first embodiment of the display device according to the invention.
Figure 2:
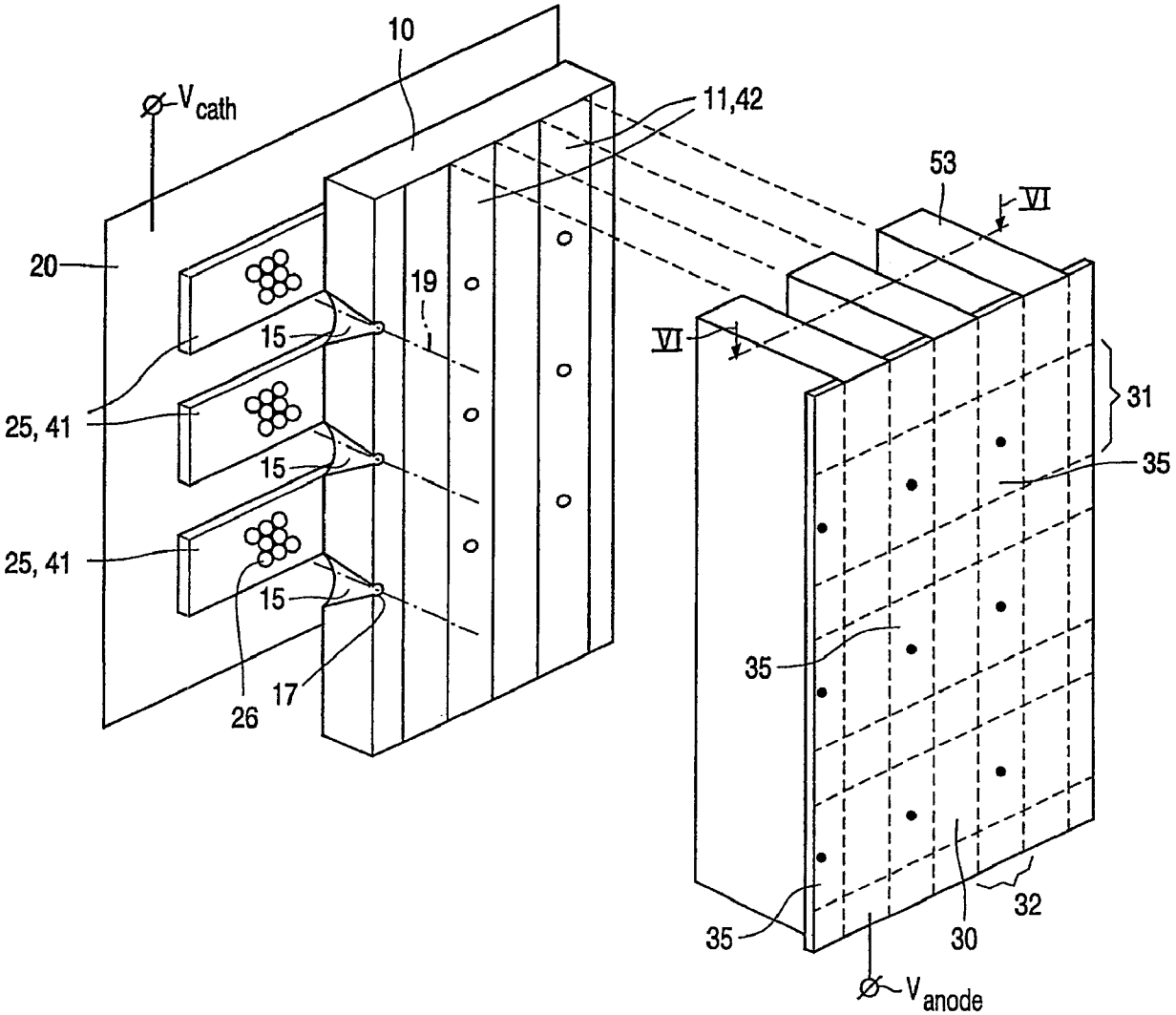
FIG. 2 is a more detailed isometric view of the first embodiment.

The first embodiment of the display device, as shown in FIG. 1 and FIG. 2, has a display screen 30 arranged adjacent a front plate 51, cathode means 20 arranged adjacent a back plate 52 for forming electron beams EB, and a channel structure 10 arranged between the display screen 30 and the cathode means 20, in proximity of the latter, the channel structure 10 being provided with electron beam guidance cavities 15. The cavities 15 are substantially funnel-shaped, with an entrance 16 being larger than an exit aperture 17.

The display screen 30 comprises picture elements (pixels) 35 arranged in rows 31 and columns 32. Each pixel 35 is provided with a luminescent material, for example a phosphor, which emits light when it is struck by an electron beam EB. In a color display device, different luescent-materials are applied, each corresponding to one of the colors red, green, and blue. The light travels through the front plate 51 towards a viewer, who watches the display device from the outside.

The display screen 30 may be rectangular, a ratio between the dimensions in the direction of the rows 31 and in the direction of the columns 32 being, for example, 16:9 or 4:3. It is desirable that the display screen 30 is flat and the thickness of the display device is as small as possible. Whereas FIG. 1 and FIG. 2 show a display screen 30 having only a few pixels 35, a real display device has a much larger number of pixels. Each pixel 35 has a surface area of about 300 μm by 1 mm.

The display screen 30 may also comprise an anode (not shown) for accelerating emitted electrons towards it. The anode receives an anode voltage of, for example, 5 kV.

The cathode means 20 comprise a cathode electrode 21, a plurality of field emitters 22 for the respective pixels 35, and gate electrodes 25 corresponding to the rows 31 of the pixels 35.

The field emitters 22 may comprise Spindt-type emitters, printed field emitters, or carbon nanotubes. They are provided on a glass substrate that is covered with the cathode electrode 21 and a resistive layer. The application of a voltage difference between the cathode electrode 21 and the gate electrode 25 energizes, the field emitters 22 into emitting electrons.

The emitted electrons are accelerated towards the channel structure 10 by the gate electrode 25. For each cavity 15, the gate electrode 25 comprises a plurality of openings 26 for passing emitted electrons, so that they may travel to the cavity 15.

The channel plate 10 has a corresponding electron beam guidance cavity 15 for each pixel 35. Each cavity 15 is funnel-shaped and has a central axis 19. The inner surface 18 of the cavity 15 is at least partly coated with an electrically insulating material having a secondary emission coefficient δ of at least 1 for a predetermined range of electron impact energies, so that the wall 18 is able to emit a secondary electron when an electron impinges on it. The material comprises, for example, magnesium oxide (MgO). The channel structure 10 has a thickness of, for example, 400 μm.

In the display device according to the invention, a majority of the ions is generated between the channel structure 10 and the display screen 30. Since the exit aperture 17 is relatively small, the ions will predominantly impact on the channel structure 10. The fraction that enters the cavity 15 through the exit aperture 17 and is subsequently able to reach the cathode means 20 is relatively small. The number of collisions of ions with the cathode means 20 is reduced thereby, and the image brightness over the lifetime of the display device is improved.

The screen-facing side of the channel plate 10 is provided with a hop electrode 11 for each of the columns 32 of pixels 35 on the display screen 30. In operation, a hop voltage is applied to the hop electrode 11 to establish an electric field within the cavity 15, for enabling hopping transport of electrons through the cavity 15. The number of electrons that exit the cavity 15 through the exit aperture 17 is equal to the number of electrons that entered the cavity 15, thus achieving a guidance of an electron beam EB that enters the cavity 15.

In general, the exit aperture 17 of the cavity is smaller than the entrance 16 facing the cathode means 20. Preferably, the ratio of the surface area of the entrance 16 to the exit aperture 17 should be considerably greater than 1, for example, 5 or 20.

For example, the diameter of the entrance 16 is 600 micrometers and the diameter of the circular exit aperture 17 is 100 micrometers. Preferably, the exit aperture 27 may have an elongate shape, the major diameter thereof being 300 micrometers and the minor diameter being 100 micrometers. This is especially advantageous in a color display device having elongate sub-pixels.

The beam current density of the electron beam EB is greater at the exit aperture 17 of the cavity than at the entrance 16. For example, the beam current density at the exit aperture is 50 or 100 times greater. In this case, the emitted electrons from a relatively large part of the cathode means 20 are collected in the electron beam EB, so that the electron beam EB has a good spatial uniformity and a particularly high brightness.

Figure 3:
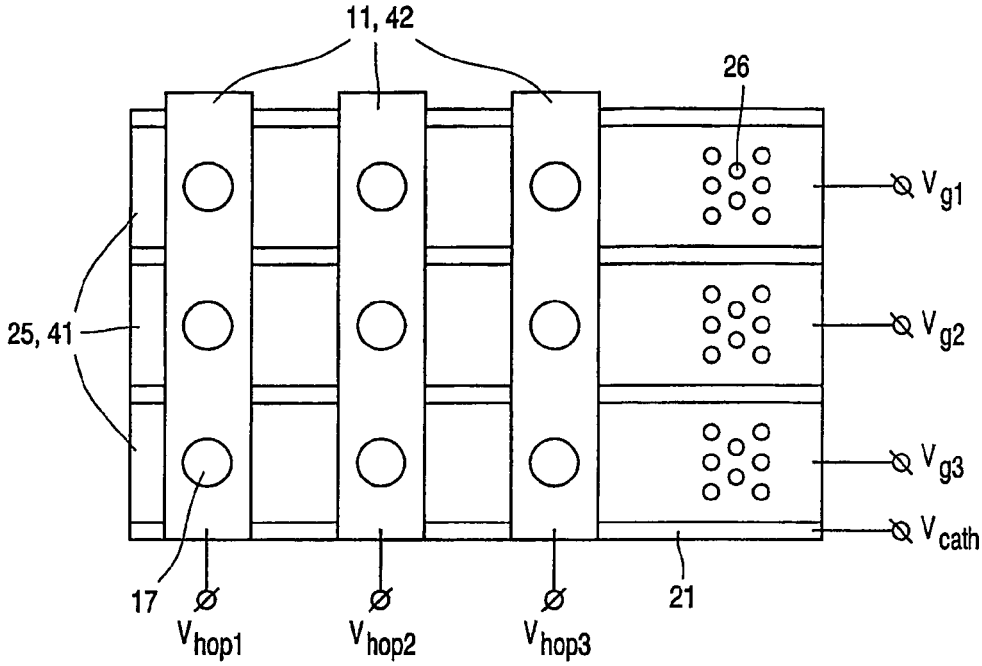
FIG. 3 is a schematic view of the addressing means in the first embodiment.

The addressing means 41,42 in the first embodiment will now be described in more detail with reference to FIG. 3.

The addressing means comprise the gate electrodes 25 operating as row electrodes 41 and the hop electrodes 11 operating as column electrodes 42. In this embodiment, the pixels 35 are addressed by means of normal scanning.

The gate electrodes 25 each receive a corresponding gate voltage Vg1, Vg2, Vg3, which may independently have a first value allowing the passage of emitted electrons through the openings 26 in the gate electrode 25, or a second value at which no emitted electrons pass the gate electrode 25. Since the pixels 35 are addressed 'line-at-a-time', only one of the gate voltages Vg1, Vg2, Vg3 can have the first value at any time, while all the other gate voltages have the second value. Thus only a single row 31 of pixels 35 is selected. A frame of the image information is written onto the display screen 30 through a consecutive selection of each of the rows 31 of pixels 35.

The beam current of the electron beams EB can be modulated for each column 32 of pixels 35 through changing of the hop voltage Vhop1, Vhop2, Vhop3 applied to the hop electrode 11 corresponding to said column 32 of pixels 35. Since only a single row 31 of pixel 35 is selected at a time, the beam current of the electron beams EB can be modulated independently for each of the pixels 35 in said row 31.

The beam current of the electron beams EB may be modulated by means of pulse height modulation, so that the beam current of the electron beams EB may be controlled by the value of the hop voltage Vhop1, Vhop2, Vhop3, in accordance with the supplied image information. In this case, the beam current of the electron beam EB is zero if the hop voltage Vhop1, Vhop2, Vhop3 is lower than a predetermined threshold hop voltage, and the beam current has its greatest value when the hop voltage Vhop1, Vhop2, Vhop3 is equal to a predetermined maximum hop voltage. At the maximum hop voltage, as many electrons leave the exit aperture 17 of the cavity 15 as enter it through the entrance 16.

For example, the threshold hop voltage lies within a range of 50 to 200 volts, and the maximum hop voltage, being higher than the threshold hop voltage, lies within a range of 100 to 500 volts.

Alternatively, the beam current of the electron beam EB may be controlled by means of pulse width modulation.

Figure 4:
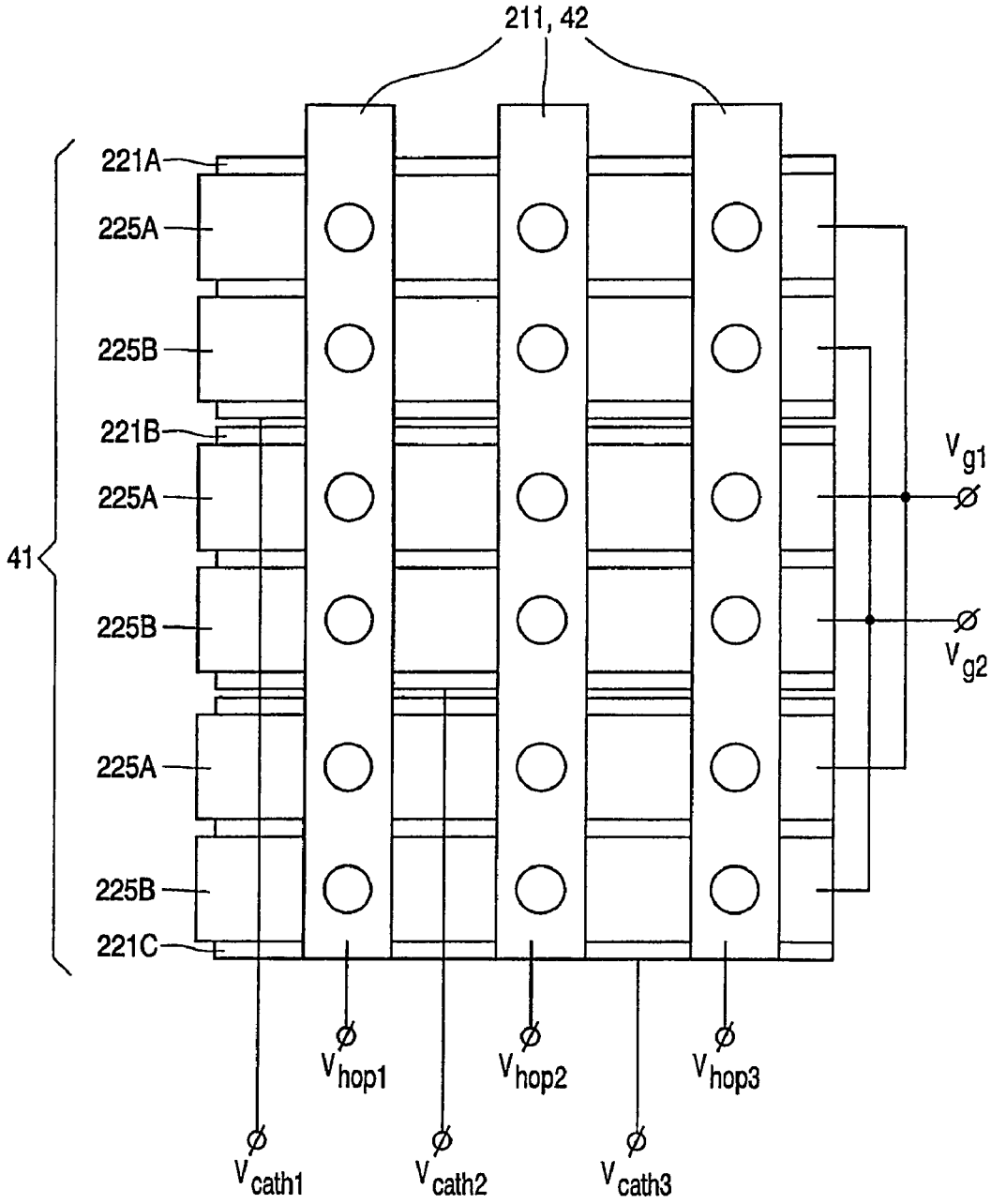
FIG. 4 is a schematic view of an alternative embodiment of the addressing means.

In the alternative embodiment of the addressing means according to FIG. 4, multiplexing addressing is applied to the rows 31 of pixels 35, as described earlier in this document. The cathode means are now divided into three segments 221A, 221B, 221C. Each of the segments 221A, 221B, 221C receives a corresponding cathode voltage Vcath1, Vcath2, Vcath3 during operation. Corresponding gate electrodes 225A, 225B are interconnected for each of the segments 221A, 221B, 221C, so that together they constitute the addressing means 41 for the rows 31 of pixels 35. The first group of gate electrodes 225A receives a first gate voltage Vg1, and the second group of gate electrodes 225B receives a second gate voltage Vg2.

In the conventional, non-multiplexing addressing configuration, six row voltages would be supplied for addressing six rows of pixels 35, whereas in the multiplexing addressing configuration only five row voltages (Vcath1, Vcath2, Vcath3, Vg1, Vg2) are required. In a real display device, the reduction in the number of row voltages and in the number of external connections for supplying the row voltages will be greater. For example, in a display device having 600 rows, wherein the cathode electrode is divided into 10 segments, the required number of row voltages is 70 instead of 600. However, the power consumption of multiplexing addressing may be higher than the power consumption of conventional addressing.

Figure 5:
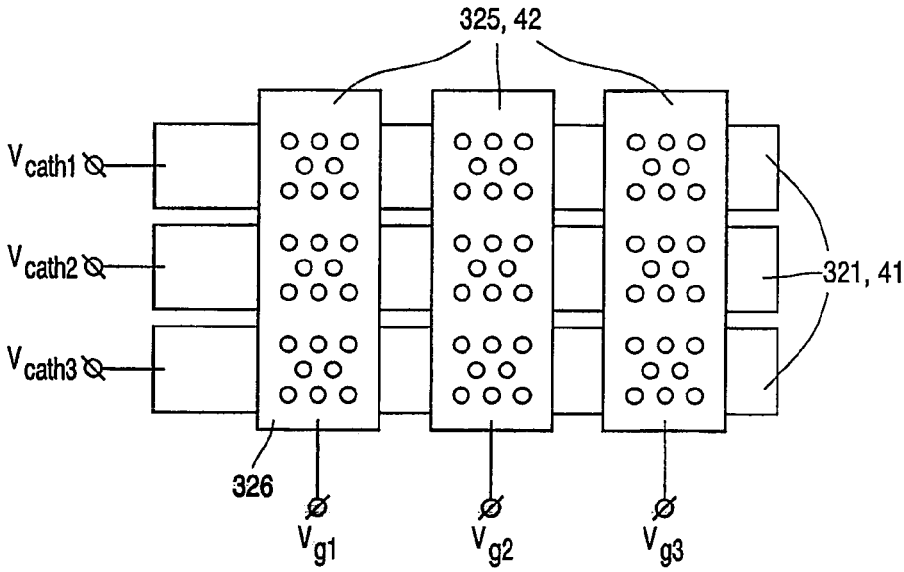
FIG. 5 is a schematic view of another alternative embodiment of the addressing means.

In another alternative embodiment for the addressing means, as shown in FIG. 5, the cathode means consist of a line cathode 321 for each of the rows 31 of pixels 35. A row 31 of pixels 35 is selected by setting the corresponding one of the cathode voltages Vcath1, Vcath2, Vcath3 to a first value allowing the emission of electrons, and the other cathode voltages to a second value not allowing emission.

The addressing means comprise a gate electrode 325 for each of the columns 32 of pixels 35. The modulation of the beam current of the electron beam EB passing through the openings 326 in a gate electrode 325 can be done by pulse height modulation of the gate voltages Vg1, Vg2, Vg3, or by pulse width modulation of the gate voltages.

This embodiment has the advantage that the addressing is completely carried out within the cathode means. Thus a single hop electrode may be applied, covering substantially the entire screen-facing surface of the channel structure 10. Moreover, this hop electrode can receive a fixed voltage, so that the hopping transport properties of the cavities 15 do not change during operation.

Figure 6:
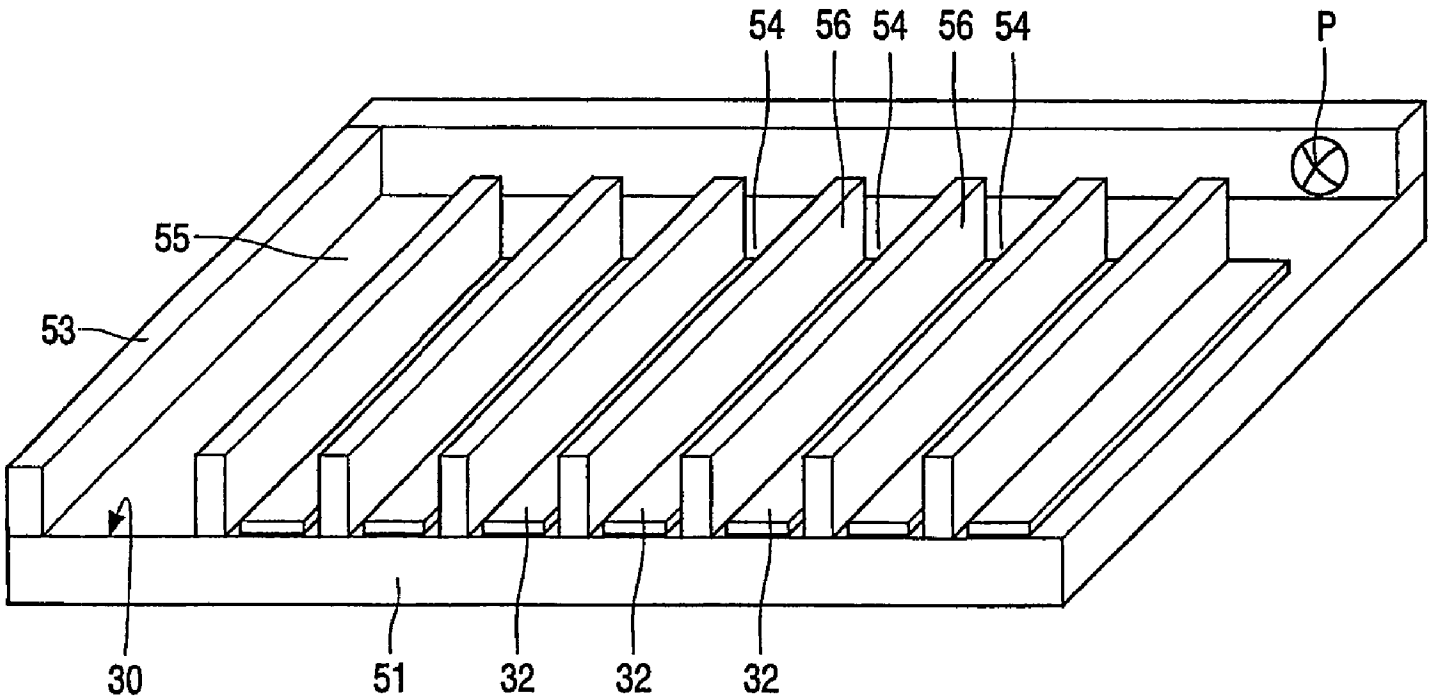
FIG. 6 is a side view of the front plate and the spacer in the first embodiment.

The display device comprises a vacuum envelope 50 formed by the front plate 51, the back plate 52, and the spacer 53. The spacer 53 and the front plate 51 are shown in more detail in FIG. 6. The spacer 53 provides vacuum support to the display device and comprises a pump chamber 55 for pumping the display device.

For each column 32 of pixels 35, the spacer 53 has a corresponding chamber 54 extending substantially along the column 32 of pixels 35. Neighboring chambers 54 are separated by a barrier 56 which extends along the sides of the chamber 54 in the direction of motion of the electrons, from the display screen 30 to the channel structure 10. The height of the barrier 56, i.e. the distance between the display screen 30 and the channel structure 10, is, for example, 3 mm.

The chambers 54 are in open communication with the pump chamber 55 at both ends. Adjacent the channel structure 10, the chamber 54 is connected to the cavities 15 of the corresponding column 32 via the exit aperture 17. During the evacuating process, a pump is connected to the pump chamber 55 via a pump valve P. This renders it possible to achieve vacuum conditions throughout the entire display device.

Figure 7:
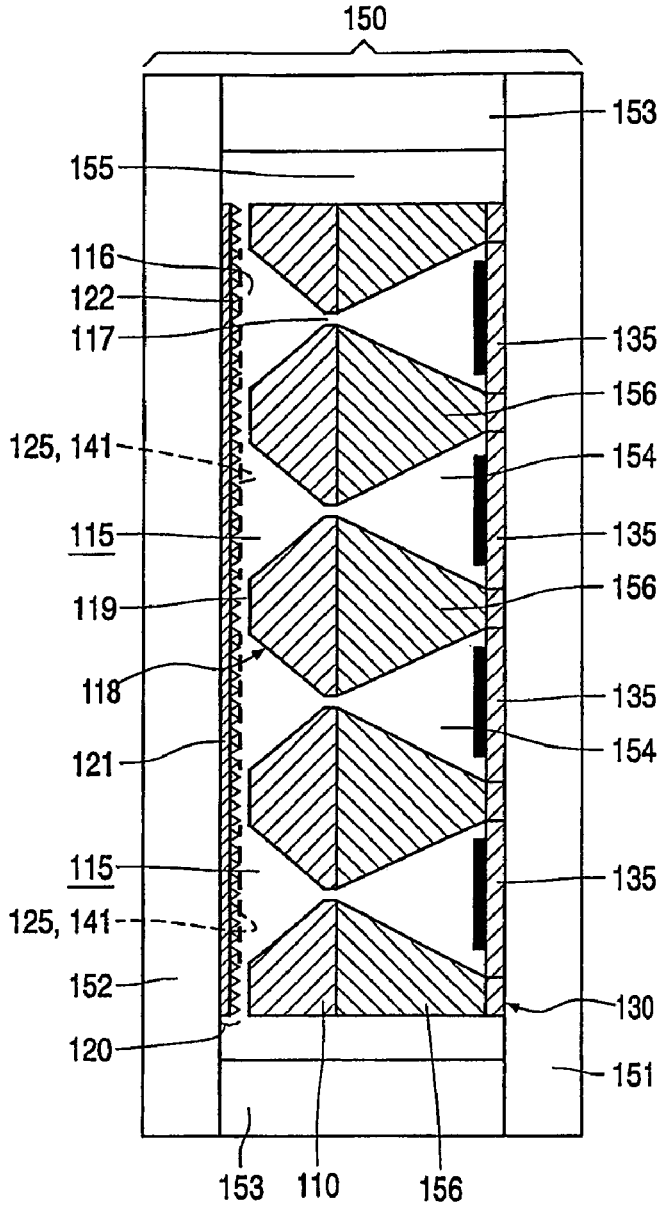
FIG. 7 shows a second embodiment of the display device according to the invention.

The second embodiment of the display device as shown in FIG. 7 is largely similar to the first embodiment, except for adaptations to the spacer and the channel structure. The second embodiment comprises a vacuum envelope 150 with a front plate 151, a back plate 152, and a spacer 153.

The spacer 153 has a pump chamber 155 adjacent the sides of the vacuum envelope 150 and is provided with a single chamber 154 corresponding to each of the pixels 135 on a display screen 130. Neighboring chambers 154 are separated by barriers 156.

The chamber 154 has a cylindrical or conical shape and extends in the direction of motion of the electrons, between the pixel 135 and the exit aperture 117 of the corresponding cavity 115 in the channel structure 110. On the screen-facing side of the channel structure 110, a hop electrode 111 is provided for each of the columns 32 of pixels 135, so that the hop electrode 111 is arranged to address said columns.

A gate electrode 125 is present for each row of pixels 135 and controls the electron emission from cathode means 120 for said row. The addressing means operate in a similar way as the addressing means in the first embodiment.

Neighboring cavities 115 of the channel structure 110 are interconnected by openings 119. The diameter of the openings 119 should be such that an unrestricted gas flow through them is possible.

The drawing shows openings 119 provided in the column direction, but openings may alternatively be provided in the row direction, or in both directions. The cavities 115 at the lateral ends of the channel structure 110 are connected to the pump chamber 155 through similar openings 119.

Alternatively, similar openings could be provided in the barriers 156 separating the chambers 154.

Each of the cavities 115 and each of the chambers 154 in the spacer 153 is connected to the pump chamber 155. During evacuating of the display device, a pump is connected to the pump chamber 155. This embodiment provides good vacuum conditions throughout the display device.

Figure 8:
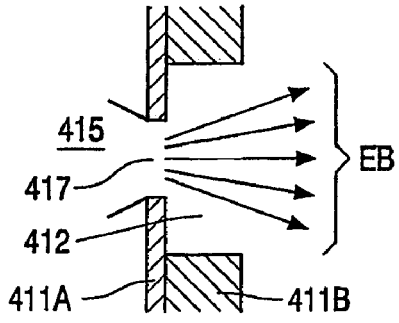
FIG. 8 shows a preferred embodiment of the hop electrode adjacent the exit aperture of a single cavity in the channel structure.

In FIG. 8, a hop electrode is shown which comprises a cup lens consisting of a relatively thin first annular part 411A and a relatively thick second annular part 411B, extending from the first part 411A towards the display screen 30. The first part 411A has an opening corresponding to the exit aperture 417 of the cavity 415. The second part 411B has a circular aperture 412 with a larger diameter.

The cup lens may be used for adapting the cross-sectional area or shape of the electron beam emitted from the cavity 415 to the cross-section of the pixels 35 on the display screen 30. By adjusting the diameter of the aperture 412, the thickness of the second part 411B, and/or the hop voltage, the cross-section of the electron beam EB can be made such that it fills the pixels 35 as well as possible. Thus the luminescent material in the pixel 35 is maximally used, and the displayed image has a relatively high brightness.

If the pixels 35 of the display screen 30 are elongated in shape, it is advantageous for the aperture 412 to have an elliptical or rectangular shape. The second part 411B of the hop electrode may also have an elliptical or rectangular shape. The electron beam EB that exits from the cavity 15 now has an elongate cross-section, so as to give a maximum filling of the elongate subpixels.

The hop electrode may alternatively comprise a planar electron lens as a substitute for the cup lens. Both configurations are known per se from the cited international patent application WO 01/26131.

The hop electrode then comprises a first electrode adjacent the exit aperture of the cavity and a second electrode substantially in the same plane as the first electrode, enclosing the latter.

This configuration has the advantage that a separate voltage is applied to the second electrode, so that the strength of the planar electron lens and thus the cross-section is changeable without adaptation of the hop voltage.

The drawings are schematic and not true to scale. While the invention has been described in connection with preferred embodiments, it should be understood that the invention should not be construed as being limited to the preferred embodiments. Rather, it includes all variations which could be made thereon by a skilled person within the scope of the appended claims.

For example, the addressing of the rows of the pixels, the addressing of the columns of the pixels, or multiplexing addressing of the rows and/or the columns may be carried out by any combination of the cathode electrode, the gate electrode, and the hop electrode, by the anode electrode, or alternatively by providing the display device with supplementary electrodes or other means suitable for this purpose.

The cathode means may comprise any type of emitting element, preferably a field emitter such as a Spindt-type emitter, a carbon nanotube, or a printed field emitter, but alternatively a thermionic emitter such as an oxide-cathode or an impregnated cathode, or other types of emitters such as avalanche cold cathodes or wire cathodes.

The invention claimed is:

1. A vacuum display device comprising:

a display screen (30) for displaying image information, said display screen comprising picture elements (35) arranged in a first array;

cathode means (20) for forming a plurality of electron beams (EB) arranged in a second array, said second array being in conformity with the first array, so that each electron beam (EB) corresponds to a picture element (35) of the display screen (30);

addressing means (41,42) for addressing the picture elements (35) by modulating the corresponding electron beam (EB) in accordance with the image information and a channel structure (10) provided with electron beam guidance cavities (15) arranged in a third array, said third array being in conformity with the first array, for guiding each electron beam (EB) to the corresponding picture element (35) of the display screen (30), said electron beam guidance cavities (15) each having an entrance (16) facing the cathode means (20) and an exit aperture (17) facing the display screen (30), characterized in that said channel structure (10) is arranged adjacent said cathode means (20), and said entrance (16) is larger than said exit aperture (17).

2. A vacuum display device as claimed in claim 1, characterized in that a hop electrode (11) is provided at a side of the channel structure (10) facing the display screen (30) for each of the exit apertures (17), and an inner surface (18) of each of the electron beam guidance cavities (15) comprises an electrically insulating material having a secondary emission function so as to enable the electron beam to be guided through said cavity (15).

3. A vacuum display device as claimed in claim 2, characterized in that the cavity (15) is substantially funnel-shaped, said funnel having an apex angle in a range from 30 to 80 degrees.

4. A vacuum display device as claimed in claim 1, characterized in that the cathode means (20) comprise at least one field emitter (21) for each of the electron beams (EB).

5. A vacuum display device as claimed in claim 4, characterized in that the at least one field emitter (21) comprises a carbon nanotube, a printed field emitter, or a Spindt-type emitter.

6. A vacuum display device as claimed in claim 1, characterized in that the cathode means (20) comprise a cathode electrode (21) so as to enable electrons to be emitted from a part of said cathode means (20) for each of the electron beams (EB), and a gate electrode (25) associated with a corresponding cavity (15) in the channel structure (10) for controlling the electron emission from said part of said cathode means (20).

7. A vacuum display device as claimed in claim 1, characterized in that the addressing means (41,42) comprise a row electrode (41) and a column electrode (42), the row electrode (41) connecting the gate electrodes (25) of electron beam guidance cavities (15) arranged in a corresponding row (31), and the column electrode (42) connecting the hop electrodes (11) of electron beam guidance cavities (15) arranged in a corresponding column (32).

8. A vacuum display device as claimed in claim 7, characterized in that the cathode electrodes (21) are arranged in segments (221A, 221B, 221C), each segment corresponding to a plurality of electron beams (EB) arranged in a predetermined number of rows (31).

9. A vacuum display device as claimed in claim 1, characterized in that the addressing means (41,42) comprise a row electrode (41) and a column electrode (42), said row electrode (41) connecting the cathode electrodes (21) of electron beams (EB) arranged in a corresponding row (31), and the column electrode (42) comprises the gate electrodes (25) of electron beam guidance cavities (15) arranged in a corresponding column (32).

10. A vacuum display device as claimed in claim 1, characterized in that the vacuum display device comprises a vacuum envelope (50) having a back plate (52) adjacent the cathode means (20), a front plate (51) adjacent the display screen (30), and a spacer (53) between the front plate (51) and the back plate (52), said spacer (53) comprising a plurality of chambers (54), each chamber being arranged between a predetermined number of picture elements (35) and their corresponding electron beam guidance cavities (15), and a pump chamber (55) designed for pumping the vacuum envelope (50) and connected to each one of the plurality of chambers (54).

11. A vacuum display device as claimed in claim 10, characterized in that the spacer (153) has a single chamber (154) for each of the picture elements (135), which chamber extends between the picture element (135) and the corresponding electron beam guidance cavity (115).

12. A vacuum display device as claimed in claim 6, characterized in that the spacer (53) is provided with a single chamber (54) for a predetermined number of picture elements (35) arranged in a single column (32) of the first array.

13. A vacuum display device as claimed in claim 2, characterized in that the hop electrode (11) comprises an electron lens adjacent each of the exit apertures (17) of the cavities (15) for adapting the cross-sectional area and/or shape of the corresponding electron beam (EB) in conformity with the picture elements (35) of the display screen (30).

14. A vacuum display device as claimed in claim 1, characterized in that the exit aperture (17) has an elongate shape.

* * * * *